US005380063A

United States Patent [19]

Dauphin

[11] Patent Number: 5,380,063

[45] Date of Patent: Jan. 10, 1995

[54] CHAIR WITH SEAT DEPTH ADJUSTMENT

[75] Inventor: Friedrich W. Dauphin, Offenhausen, Germany

[73] Assignee: Dauphin Entwicklungs- u. Beteiligungs-GmbH, Neukirchen, Germany

[21] Appl. No.: 107,008

[22] Filed: Aug. 17, 1993

[30] Foreign Application Priority Data

Aug. 18, 1992 [DE] Germany ..... 4227329

[51] Int. Cl.[6] ..... B60N 2/02

[52] U.S. Cl. ..... 297/284.11

[58] Field of Search ..... 297/284.11

[56] References Cited

U.S. PATENT DOCUMENTS

| | | | |
|---|---|---|---|
| 3,883,173 | 5/1975 | Shepard et al. . | |
| 4,153,294 | 5/1979 | Meiller et al. | 297/284.11 |
| 4,500,136 | 2/1985 | Murphy et al. . | |
| 4,652,049 | 3/1987 | Maruyama et al. | 297/284.11 |
| 4,915,447 | 4/1990 | Shovar | 297/284.11 |

FOREIGN PATENT DOCUMENTS

| | | |
|---|---|---|
| 2508298 | 12/1982 | France . |
| 2028135 | 2/1971 | Germany . |
| 3306992 | 2/1983 | Germany . |
| 4040138 | 6/1992 | Germany . |

*Primary Examiner*—Peter R. Brown
*Attorney, Agent, or Firm*—Browdy and Neimark

[57] ABSTRACT

A chair, in particular an office chair, is provided with a chair frame, a seat supported thereon and a backrest. The seat comprises a base portion constituting the main face and a rim portion supported on its front rim to be pivotable about a horizontal transverse axis and which is adjustable into different pivoted positions referred to the base portion by means of an adjusting mechanism for adjustment of the seat depth of the seating face.

The adjusting mechanism comprises an adjusting spindle rotatably supported on the base portion in parallel to the transverse axis underneath the seat and on which a two-armed adjusting lever extending at right angles to the adjusting spindle is supported to be pivotable about the adjusting spindle and to be displaceable in the direction of the spindle axis by a spindle rotation. With its bracket facing the rim portion the adjusting lever is in articulated connection with the rim portion. With its guide arm facing the base portion the adjusting lever is in engagement with an inclined guidance of a guide link on the base portion, so that when transversely displaced occasioned by the spindle rotation the adjusting lever and with it the rim portion are pivotable.

8 Claims, 4 Drawing Sheets

CHAIR WITH SEAT DEPTH ADJUSTMENT

BACKGROUND OF THE INVENTION

1. Field of the Invention

The invention relates to a chair and in particular an office chair with a chair frame, a seat supported thereon and a backrest, the seat comprising a base portion forming the main seating face and a rim portion supported on the latter's front rim to be pivotable about a horizontal transverse axis and forming the front rim section of the seating face, the rim portion being adjustable into different pivoted positions referred to the base portion by means of an adjusting mechanism.

2. Background Art

A chair of the generic type is known from German patent 20 28 135. In this chair, which is a driver's seat for a motor vehicle supported on the vehicle floor for longitudinal displacement, the rim portion pivotably supported on the base portion is coupled with the displacement mechanism of the chair by way of a complicated linkage and adjusting construction. Such a construction is not suited for a conventional chair nor, in particular, an office chair.

SUMMARY OF THE INVENTION

It is the object of the invention to improve a chair of the generic type such that its adjusting mechanism for seat depth adjustment is of constructionally simple structure and actuatable independently of further adjustment functions in the chair.

This object is attained by a chair, wherein the adjusting mechanism comprises an adjusting spindle, which is rotatably supported in parallel to the transverse axis underneath the seat on the base portion and on which a two-armed adjusting lever extending at right angles to the adjusting spindle is supported to be pivotable about the adjusting spindle and to be transversely displaceable by a spindle rotation in the direction of the spindle axis, and wherein with its bracket facing the rim portion the adjusting lever is in articulated connection with the rim portion and with its guide arm facing the base portion is in engagement with an inclined guidance of a guide link on the base portion, such that when transversely displaced occasioned by the spindle rotation the adjusting lever and with it the rim portion are pivotable. Accordingly, the adjusting mechanism only consists of two movable components, namely the adjusting spindle and the two-armed adjusting lever supported on the latter. The adjusting spindle takes a double function, namely the pivotable support of the adjusting lever on the one hand and, on the other hand, the latter's pivoting drive, which is effected by means of a transverse displacement of the adjusting lever along the adjusting spindle and by the adjusting lever being correspondingly guided in a guide link with inclined guidances.

The preferred embodiments, according to which on the one hand the inclined guidance in the guide link is formed by an oblong-hole-shaped guide opening flanking the guide arm of the adjusting lever in the direction of displacement on both sides and, biased in relation to the horizontal line, extending on a vertical plane parallel to the spindle axis, and on the other hand a further guide link is provided on the bottom side of the rim portion and, with a guide web, engages with a positively guiding recess, which extends transversely in the bracket of the adjusting lever and which is located on the bottom side of the adjusting lever facing away from the rim portion, ensure that, on the one hand, the adjusting lever is positively guided, so that the latter is positively pivoted during transverse displacement in both slide directions by reason of the oblong-hole-shaped guide opening, which would not be ensured with a one-side guide face. On the other hand, the positive guidance of the rim portion is produced by the second guide link on the bottom side of the rim portion.

It is thus ensured that the rim portion will follow any pivot movement of the adjusting lever, even if not weighted from above for instance by the tighs of someone sitting on the chair.

According to further preferred embodiments of the invention the side walls of the guide web are formed as guide faces biased in relation to the spindle axis and flanked by corresponding counter-guide-faces of the positively guiding recess on the adjusting lever. Besides, the side of the guide web facing the bottom side of the adjusting lever is formed as an additional guide face flanked by the bottom of the positively guiding recess. This is to that support the positive guidance of the rim portion. In particular, it is ensured by the claimed measures that the guide faces of the rim-portion guide link and of the adjusting lever do not wedge each other.

As a result of the preferred arrangement of two adjusting levers with correspondingly associated guide links on the base portion and possibly on the rim portion, the distribution of the weights introduced by someone sitting on the chair via the rim portion into the latter's adjusting mechanism is improved, as a result of which the risk of wear and rupture of the adjusting levers and the guide links decreases. This also improves the ease of operation of the adjusting mechanism.

The adjusting mechanism being self-retaining, there is no need of special locking devices which arrest corresponding parts of the adjusting mechanism in a set position.

By means of the continuous upholstery of the chair, which covers both the base and the rim portion, the gap between the base and the rim portion is covered, which prevents clothes from being caught in the diminishing gap when the rim portion is positioned. Moreover, the continuous upholstery gives the chair an attractive appearance.

In connection with the continuous upholstery, the positive guidance of the rim portion gains some special importance. To avoid creases, upholstery chair covers are as a rule stretched over the seat substructure formed by the base and the rim portion. The positive guidance of the rim portion missing, the adjusting lever would move off downwards when the rim portion simply bears on it, without the rim portion following this pivot movement. By comparison, as a result of the positive guidance the rim portion is actively moved downwards during this pivot movement.

Further features, details and advantages of the invention will become apparent from the ensuing description of an exemplary embodiment taken in conjuction with the drawing.

DESCRIPTION OF THE PREFERRED EMBODIMENT

Figure 1:
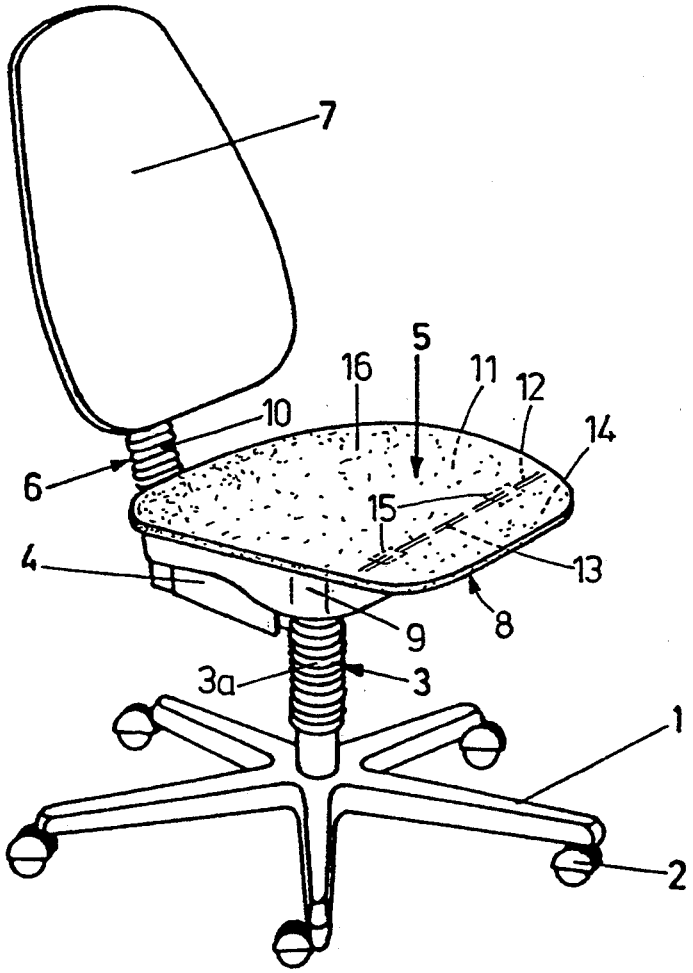
FIG. 1 is a perspective view of a chair.
Figure 2:
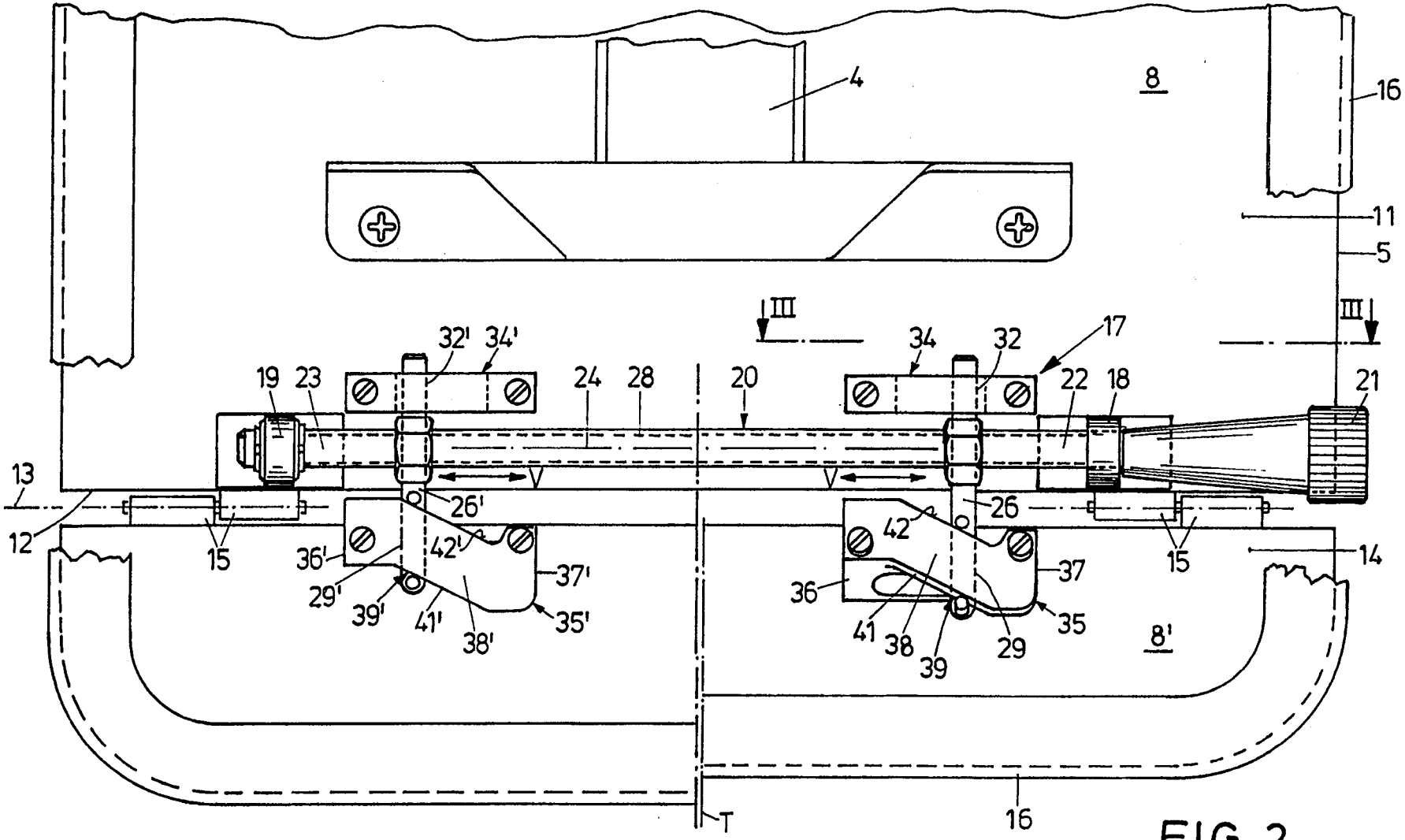
FIG. 2 is a diagrammatic view from below of the chair seat.

An office chair illustrated in FIG. 1 has a chair frame comprising a pedestal 1 with casters 2 as well as a vertically adjustable chair column 3 attached to the pedestal 1 and surrounded by bellows 3a. A seat support 4, of which the front end is seen in FIG. 2, is detachably secured to the upper end of the chair column 3. An upholstered seat 5 as well as a backrest support 6, which extends substantially upwards and to the upper end of which a backrest 7 is secured, are arranged on the seat support 4. Further, a casing 9 partially extending over the bottom side 8 of the seat to cover the seat support 4 optically is seen in FIG. 1. The backrest support 6 is coated by bellows 10 for optical reasons.

The seat 5 has a supporting base portion 11 in the shape of a substantially plane, rectangular plate constituting the main seating face as well as a rim portion 14 constituting the front rim section of the seating face and supported on the front rim 12 of the base portion 11 to be pivotable about a horizontal transverse axis 13. The rim portion 14 essentially consists of a plate, which is narrow in the longitudinal direction of the seat, which extends over the width of the seat and which is convexly arched towards the seating face. The pivotable support of the rim portion 14 on the base portion 11 is produced by a suitable hinging 15, as outlined in FIGS. 2, 4, 5 and 6.

The base portion 11 and the rim portion 14 in common are provided with a continuous upholstery 16, which is stretched and then folded around the outer edges of the seat 5, where it is correspondingly fixed on the latter's bottom side 8.

Figure 6:
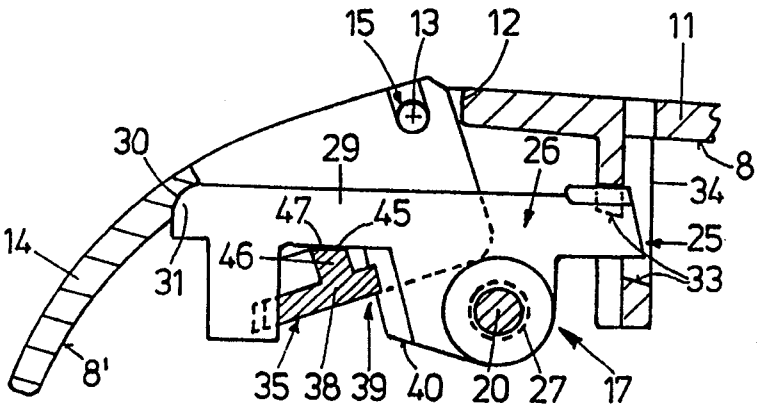
Figure 5:
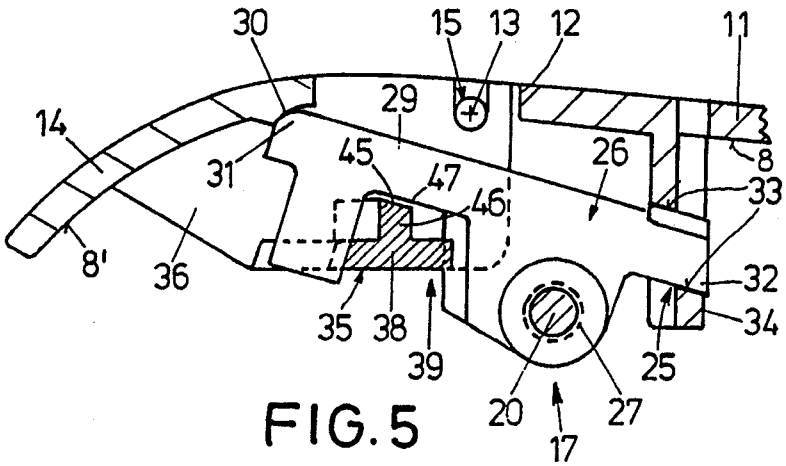
Figure 7:
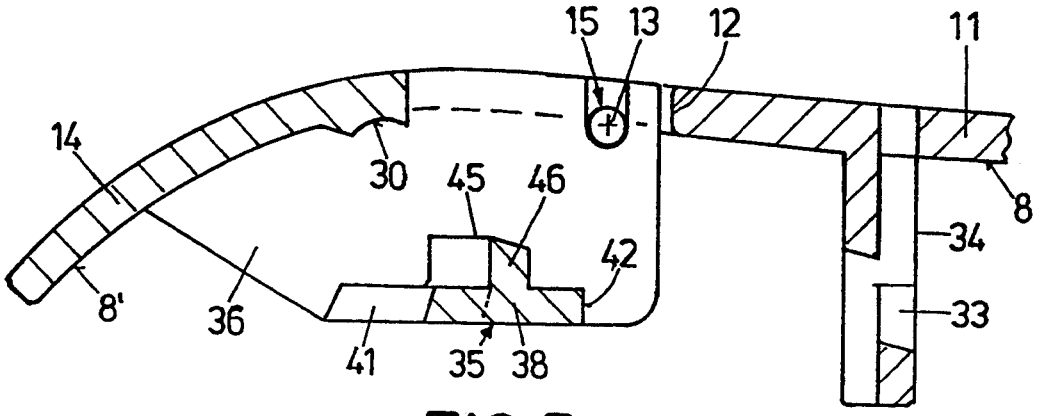
FIG. 7 is a section corresponding to FIGS. 5 and 6 with the adjusting lever being omitted.
Figure 10:
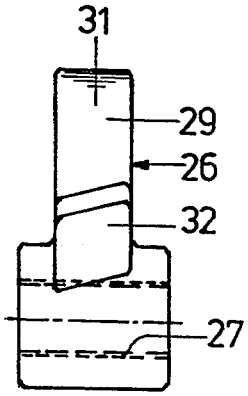
FIGS. 8 to 10 show a lateral view, a plan view and a rear view of the adjusting lever.
Figure 8:
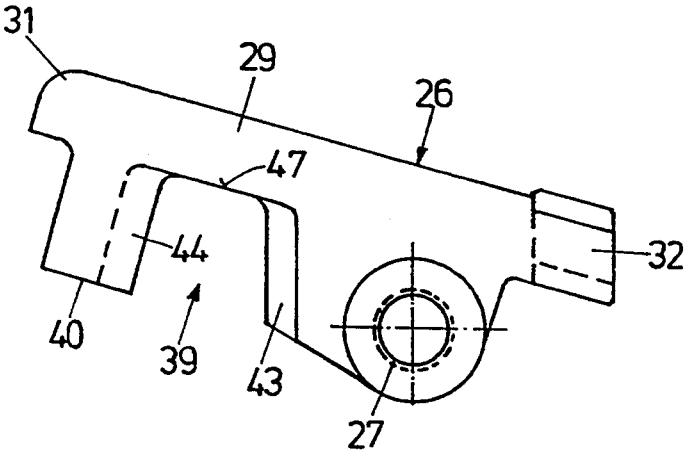
Figure 9:
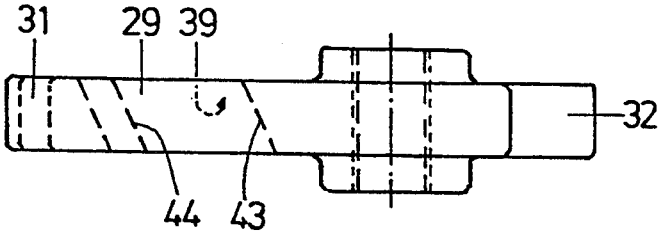

Underneath the joint between the base portion 11 and the rim portion 14, an adjusting mechanism 17 is arranged by means of which the rim portion 14 can be set in different pivoted positions referred to the base portion 11, as becomes apparent from a comparison of FIGS. 5 and 6. When the rim portion 14 is pivoted downwards, the tigh of someone sitting on the seat 5 loses contact with the seating face in the vicinity of the front rim 12 of the base portion 11, so that the seat depth of the rim portion adjustment according to FIG. 6 is reduced as compared with the status shown in FIG. 5.

The adjusting mechanism 17 has an adjusting spindle 20 rotatably supported on the base portion 11 by way of two bearing blocks 18, 19 in parallel to the transverse axis 13 underneath the seat 5; a twist handle 21 for manually twisting the adjusting spindle 20 is secured to one end of the latter. Before the end 22 on the grip side and the opposite end 23 of the adjusting spindle 20, two-armed adjusting levers 26, 26' each arranged at right angles to the adjusting spindle 20 are pivotably supported on the latter by means of an internal thread 27 on the external thread 28 of the adjusting spindle 20. Due to the thread engagement of the internal thread 27 and the external thread 28, the adjusting levers 26, 26' are transversely displaceable in the direction of the spindle axis 24 by a spindle rotation.

With its bracket 29, 29' facing the rim porting 14 each adjusting lever 26, 26' is articulated on the rim portion 14. To this end, the rim portion 14 rests with a bearing groove 30, which extends approximately parallel to the transverse axis 13 on the bottom side 8, on a projecting nose 31 at the free end of the bracket 29, 29' of each adjusting lever 26, 26' (FIGS. 5, 6). This bearing groove 30 is concavely arched in cross-section and, together with the projection 31 of the adjusting levers 26, 26', forms a rotary slide articulation.

With their guide arms 32, 32' facing the base portion 11 the adjusting levers 26, 26' are in engagement with an inclined, double-sided guidance 33 arranged in guide links 34, 34', which, from the bottom side 8 of the base portion 11, extend as block-type projections downwards at right angles. The inclined guidances 33 are formed by the side walls of about oblong-hole-shaped guide openings 25, 25' in the guide links 34, 34' flanking the guide arms 32, 32' of the adjusting levers 26, 26' on both sides in the direction of displacement. They extend on a vertical plane which is parallel to the spindle axis, at an angle of about 30° referred to the horizontal line.

Opposite the guide links 34, 34' two further guide links 35, 35' are provided on the bottom side 8' of the rim portion 14 and have each two lateral cheeks 36, 37, 36', 37' arranged in parallel to the longitudinal direction L of the seat at a distance from each other and projecting downwards from the bottom side 8' of the of the rim portion 14. Between the free ends of these lateral cheeks 36, 37, which face away from the bottom side 8' of the seat, a guide web 38, 38' is in each case arranged, which engages with a positively guiding recess 39, 39' on the bottom side 40 of the adjusting lever facing away from the rim portion. The parallel side walls 41, 42, 41', 42' facing away from each other, of the guide webs 38, 38' are formed as biased guide faces referred to the spindle axis 24, which are flanked by the correspondingly biased side walls 43, 44 facing each other, of the positively guiding recess 39 on the adjusting levers 26, 26'.

Further, the guide webs 38, 38' of the guide links 35, 35' have additional guide faces on their side facing the bottom side 40 of the adjusting levers 26, 26', which are formed by the upward face 45 of the rib 46 on the guide web 38, 38'. The faces 45 are flanked by the bottom 47 of the positively guiding recess 39 of the adjusting levers 26, 26' (FIGS. 5, 6).

Figure 4:
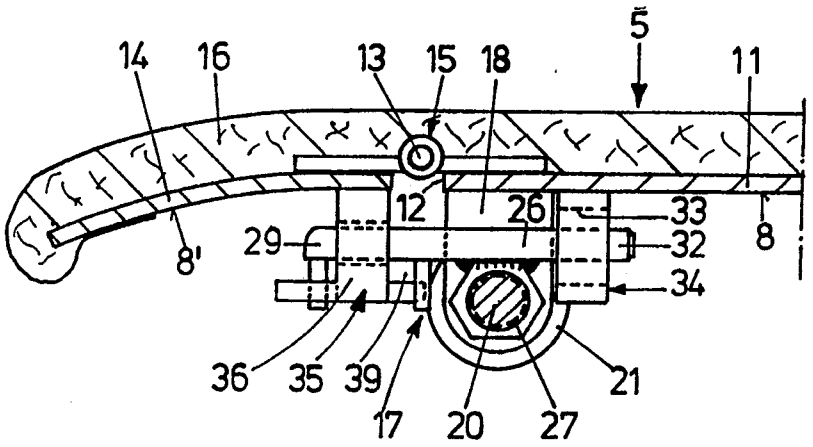
FIG. 4 is a diagrammatic sectional view of the seat along the section line IV—IV of FIG. 3, FIGS. 5 and 6 show a section corresponding to FIG. 4 of a concrete embodiment of the seat in two different pivoted positions of the rim portion.
Figure 3:
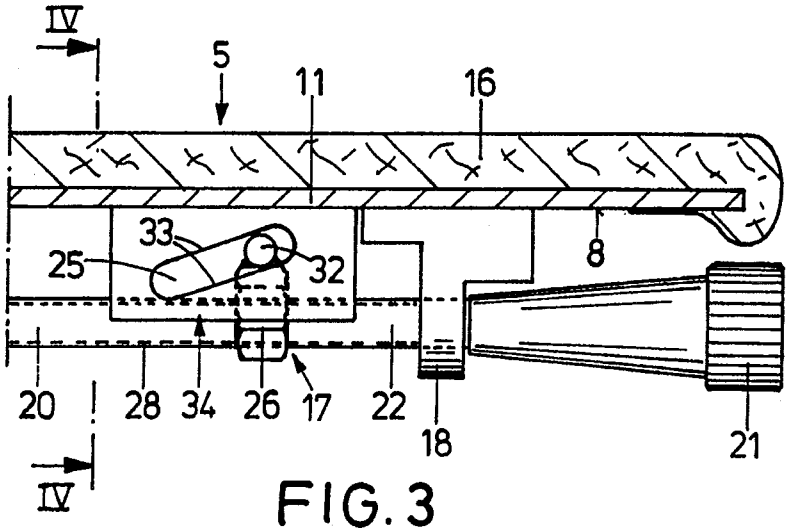
FIG. 3 is a diagrammatic sectional view of the seat along the section line III—III of FIG. 2.

In the following the functioning of the adjusting mechanism will be explained taken in conjunction with FIGS. 2 to 4 diagrammatically illustrated and FIGS. 5 and 6:

In the section on the left of the parting line T of FIG. 2 as well as in FIGS. 4 and 5, the adjusting mechanism 17 and the rim portion 14 are shown in a position when pivoted up. The adjusting levers 26' (FIG. 2) are located in the vicinity of the end of the guide webs 38' of the guide links 35'. The guide arms 32' of the adjusting levers 26' being arranged in the vicinity of the end of the inclined guidances 33 in the guide links 34', which end is spaced far away from the bottom side 8, the adjusting lever 26' is—as mentioned—pivoted up maximally. In its position associated therewith the rim portion 14 supports the tighs of someone sitting on the seat 5. Any weights imparted via the bearing groove on the adjusting levers 26' are compensated by the guide arms 32' of the adjusting levers 26' being supported at right angles to the inclined guidance 33.

For pivoting the rim portion 14 downwards the adjusting spindle 20 is rotated. As a result of its being rotated, the adjusting levers 26, 26' are displaced at right angles to the spindle axis 24, the guide arms 32, 32' of the adjusting levers 26, 26' moving along the inclined guidance 33 in the guide links 34, 34'. On this occasion the adjusting levers 26, 26' are pivoted downwards. Simultaneously, by reason of the guide webs 38, 38' of the guide links 35, 35' engaging with the positively guiding recesses 39, 39' in the adjusting levers 26, 26', the adjusting levers 26, 26' move the rim portion 14 around the hinging 15 downwards and inwards. The rim portion 14 thus takes its position pivoted downwards, as shown in the section on the right of the parting line T of FIG. 2 as well as in FIGS. 3 and 6.

It is self-evident that the rim portion 14 is pivoted upwards by the adjusting spindle 20 being rotated the other way round. There is a positive guidance of the rim portion 14 in both pivoting directions as a result of the engagement of the adjusting levers 26, 26' with the guide links 34, 34', 35, 35'.

The frictional relations of the movable components that are in engagement with each other and the angle of the guidances in the guide links 34, 34', 35, 35' being appropriately chosen, this will result in making the adjusting mechanism self-retaining.

What is claimed is:

1. A chair, in particular an office chair, with a chair frame (1,3), a seat (5) supported thereon and a backrest (7), the seat comprising a base portion (11) forming the main seating face and a rim portion (14) supported on the latter's front rim (12) which rim portion (14) is pivotable about a horizontal transverse axis (13) and forms the front rim section of the seating face, the rim portion (14) being adjustable into different pivoted positions relative to the base portion by means of an adjusting mechanism (17), wherein the adjusting mechanism (17) comprises an adjusting spindle (20) with a spindle axis (24), which adjusting spindle is rotatably supported in parallel to the transverse axis (13) underneath the seat (5) on the base portion (11) and on which a two-armed adjusting lever (26, 26') comprising a bracket (29) and a guide arm (32, 32') and extending at right angles to the adjusting spindle (20) is supported to be transversely displaceable by a spindle rotation in the direction of the spindle axis (24), and wherein said bracket (29), facing the rim portion (14) of the adjusting lever (26, 26') is articulated with the rim portion (14) and wherein said guide arm (32, 32') facing the base portion (11) of the adjusting lever (26, 26') engages with an inclined guideway (33) of a guide link (34, 34') on the base portion (11), wherein the adjusting lever (26, 26'), when being transversely displaced by a spindle rotation, is pivoted about the adjusting spindle (20) due to engagement of the adjusting lever with the inclined guideway (33), thereby pivoting simultaneously the rim portion (14) about horizontal axis (13).

2. A chair according to claim 1, wherein the inclined guideway (33) in the guide link (34, 34') is formed by an oblong-hole-shaped guide opening (25) flanking the guide arm (32, 32') of the adjusting lever (26, 26') in the direction of displacement on both sides and extending slopingly relative to a horizontal line, on a vertical plane, which is parallel to the spindle axis (24).

3. A chair according to claim 1, wherein a further guide link (35, 35') comprising a guide web (38, 38') is provided on the bottom side (8') of the rim portion (14) which guide web (38, 38') engages with a positively guiding recess (39), which extends transversely in the bracket (29) of the adjusting lever (26, 26') and which is located on the bottom side (40) of the adjusting lever(26, 26') facing away from the rim portion (14).

4. A chair according to claim 3, wherein the guide web (38, 38') comprises side walls (41, 42) as guide faces which side walls (41, 42) are inclined relative to the spindle axis (24) and flanked by corresponding counter-guide-faces of the positively guiding recess (39) on the adjusting lever (26, 26').

5. A chair according to claim 3, wherein the guide web (38, 38') comprises an additional guide face (45) on the side facing the bottom side (40) of the adjusting lever (26, 26') which additional guide face (45) is flanked by the bottom (47) of the positively guiding recess (39).

6. A chair according to claim 1, comprising two adjusting levers (26, 26') with correspondingly associated guide links (34, 34', 35, 35') on the base (11) and possibly on the rim portion (14), which two adjusting levers (26, 26') are arranged at a distance from each other on the adjusting spindle (20).

7. A chair according to claim 1, wherein the adjusting mechanism (17) is self-retaining.

8. A chair according to claim 1, wherein the base (11) and the rim portion (14) comprise a continuous upholstery 16.

* * * * *